US006364453B1

(12) United States Patent
Silverbrook

(10) Patent No.: US 6,364,453 B1
(45) Date of Patent: Apr. 2, 2002

(54) THERMAL ACTUATOR

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/556,401

(22) Filed: Apr. 24, 2000

(30) Foreign Application Priority Data

Apr. 22, 1999 (AU) ..... PP9931

(51) Int. Cl.[7] ..... B41J 2/35; B41J 2/05
(52) U.S. Cl. ..... 347/44; 347/65
(58) Field of Search ..... 347/40, 44, 54, 347/65; 251/11, 129.01; 310/306, 307; 337/140, 141, 139

(56) References Cited

U.S. PATENT DOCUMENTS 5,058,856 A 10/1991 Gordon et al.
5,825,275 A 10/1998 Wuttig et al.
5,838,351 A * 11/1998 Weber et al. ..... 347/65

FOREIGN PATENT DOCUMENTS

WO WO 99/03681 1/1999

* cited by examiner

*Primary Examiner*—John Barlow
*Assistant Examiner*—Juanita Stephens

(57) ABSTRACT

A thermal actuator for micro electro-mechanical devices, the actuator comprising a first conductive arm attached at one end to a substrate, the first arm being arranged, in use, to be conductively heatable by way of a current source; wherein the first arm has a cross sectional profile along its length dimensioned so as to increase thermal heating of the arm adjacent the attachment to the substrate.

10 Claims, 11 Drawing Sheets

Top view of actuator layer (mask 4)

Side view including sacrificial layers

THERMAL ACTUATOR

FIELD OF THE INVENTION

The present invention relates to a thermal actuator for a micro electro-mechanical device. The invention is herein described in the context of an ink jet printer but it will be appreciated that the invention does have application to other micro electro-mechanical devices such as micro electro-mechanical pumps.

BACKGROUND OF THE INVENTION

Micro electro-mechanical devices are becoming increasingly well known and normally are constructed by the employment of semi-conductor fabrication techniques. For a review of micro-mechanical devices consideration may be given to the article "The Broad Sweep of Integrated Micro Systems" by S. Tom Picraux and Paul J. McWhorter published December 1998 in IEEE Spectrum at pages 24 to 33.

One type of micro electro-mechanical device is the ink jet printing device from which ink is ejected by way of an ink ejection nozzle chamber. Many forms of the ink jet printing device are known. For a survey of the field, reference is made to an article by J Moore, "Non-Impact Printing: Introduction and Historical Perspective", Output Hard Copy Devices, Editors R Dubeck and S Sherr, pages 207–220 (1988).

A new form of ink jet printing has recently been developed by the present applicant, this being referred to as Micro Electro Mechanical Inkjet (MEMJET) technology. In one embodiment of the MEMJET technology, ink is ejected from an ink ejection nozzle chamber by a paddle or plunger which is moved toward an ejection nozzle of the chamber by an electro-mechanical actuator for ejecting drops of ink from the ejection nozzle chamber.

The present invention relates to a thermal actuator for use in the MEMJET technology and in other micro electro-mechanical devices.

SUMMARY OF THE INVENTION

The invention is defined broadly as providing a thermal actuator for a micro electro-mechanical device. The actuator comprises a first conductive material arm which is attached at one end to a substrate and which, at its other end, is connected to or integrated with a movable element. The first arm is arranged, in use, to be heated by passage of electrical current and the first arm is formed along its length with a profile that functions to concentrate heating in the arm to a region adjacent the attachment to the substrate. The thermal actuator preferably includes a second arm which extends between the substrate and the movable element and which is arranged such that, when the first arm is heated, the first arm is caused to expand relative to the second arm and exert a deflecting force on the movable element.

The second arm preferably is coupled to the first arm by a coupling means and the coupling means most preferably is located intermediate the ends of the first arm. Also, the first arm preferably is formed intermediate its ends with a thermal sink.

The present invention also provides a liquid ejector comprising a nozzle chamber, a liquid ejection aperture in one wall of the chamber, a liquid ejection paddle located within the chamber and a thermal actuator extending into the chamber by way of an access aperture in a second wall of the chamber. The thermal actuator itself comprises a first conductive material arm which is attached at one end to a substrate and which is connected at its other end to the liquid ejection paddle. The first arm is arranged, in use, to be heated by passage of electrical current and the first arm is formed along its length with a profile that functions to concentrate heating of the arm adjacent its attachment to the substrate. In use of the ejector, when the first arm is heated the liquid ejection paddle is caused to move from a first position to a second position to thereby cause ejection of liquid through the liquid ejection aperture.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

Figure 1:
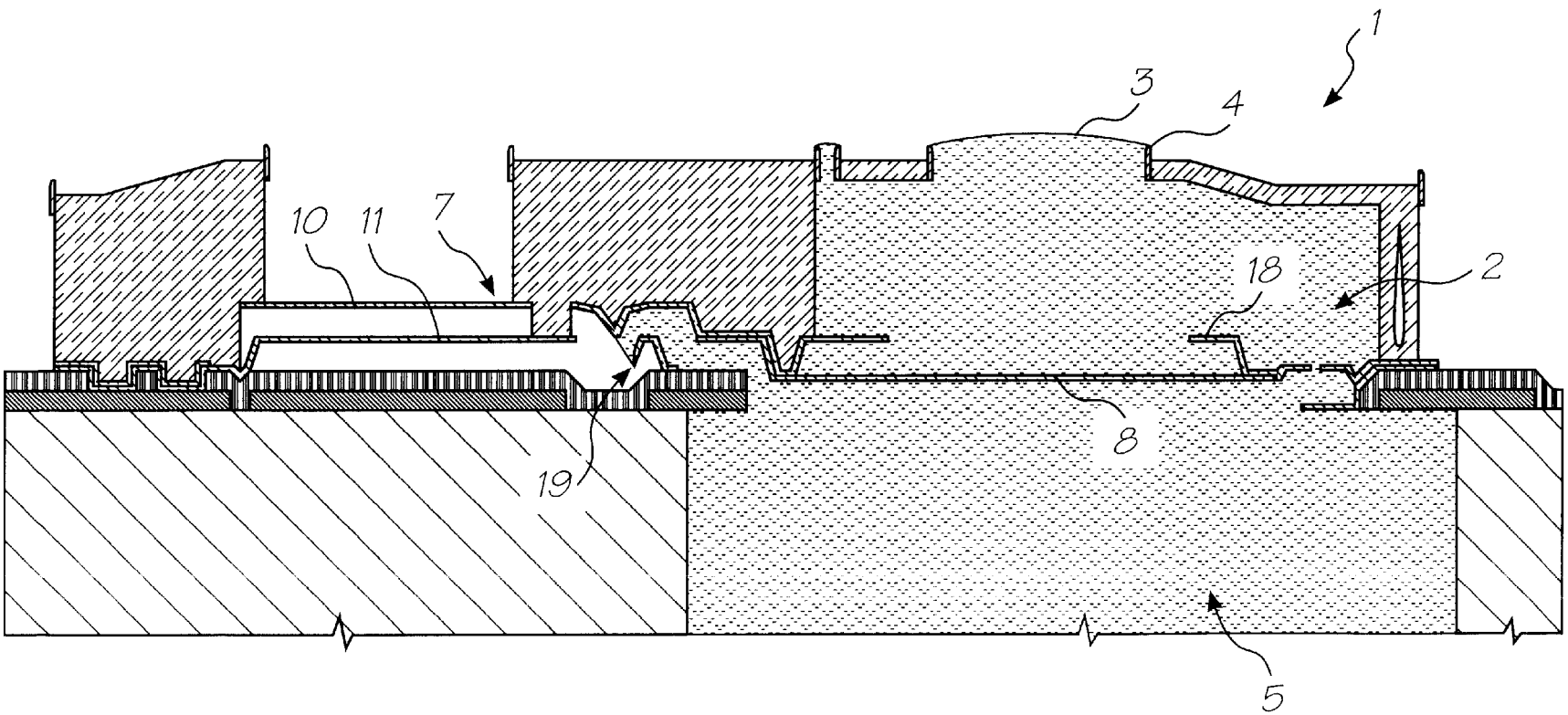
FIG. 1 to FIG. 3 illustrate schematically the operation of a thermal actuator device.

As shown in FIG. 1, there is provided an ink ejection arrangement 1 which comprises a nozzle chamber 2 which is normally filled with ink so as to form a meniscus 3 within an ink ejection nozzle 4 having a raised rim. The ink within the nozzle chamber 2 is supplied by means of ink supply channel 5.

The ink is ejected from the nozzle chamber 2 by means of a thermal actuator 7 which is connected to a nozzle paddle 8. The thermal actuator 7 comprises two arms 10 and 11, with the bottom arm 11 being connected to an electrical current supply so as to provide current induced heating of the bottom arm 11.

Figure 2:
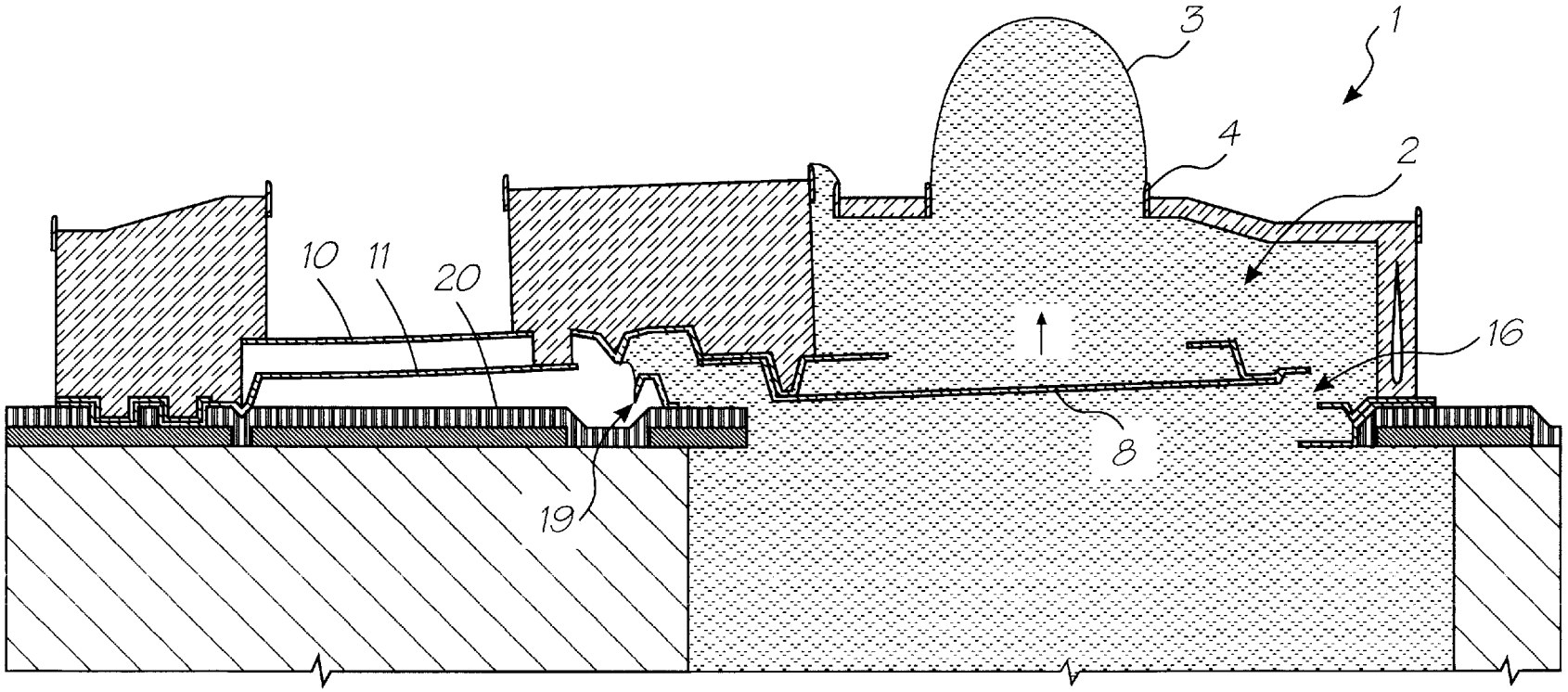
Figure 3:
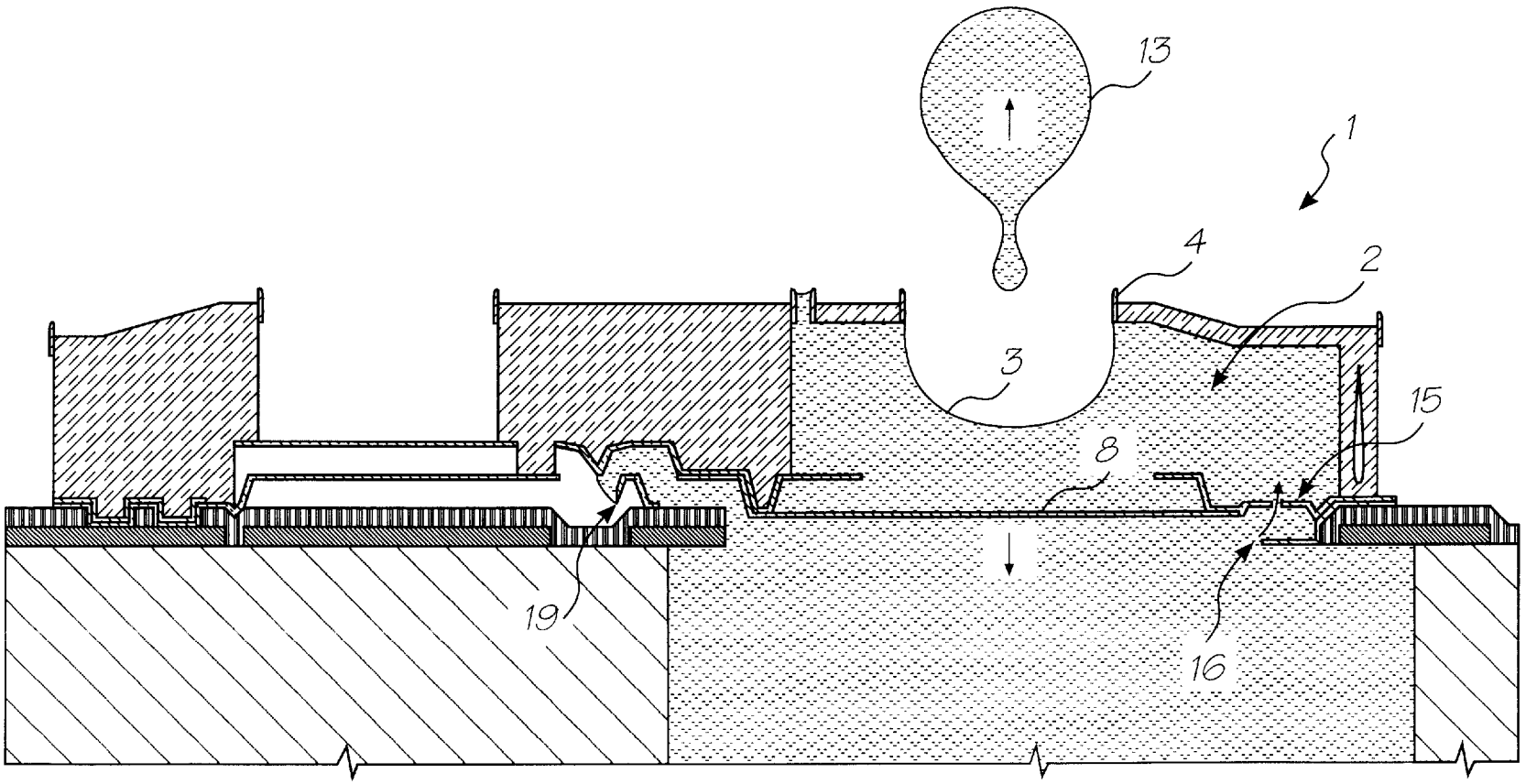

When it is desired to eject a drop from the nozzle chamber 2, the bottom arm 11 is heated so as to cause the rapid expansion of this arm relative to the top arm 10. The rapid expansion in turn causes a rapid upward movement of the paddle 8 within the nozzle chamber 2. Initial movement is illustrated in FIG. 2, with the arm 8 having moved upwardly so as to cause a substantial increase in pressure within the nozzle chamber 2. This in turn causes ink to flow out from the nozzle 4, causing the meniscus 3 to bulge. Subsequently, the current to the arm 11 is turned off so as to cause the paddle 8, as shown in FIG. 3, to begin to return to its original position. This results in a substantial decrease in the pressure within the nozzle chamber 2. The forward momentum of the ink outside the nozzle rim 4 results in necking and breaking of the meniscus so as to form a new meniscus 3 and a droplet 13 as illustrated in FIG. 3. The droplet 13 moves forwardly onto an ink print medium (not shown).

The nozzle chamber has a profiled edge 15 which, as the paddle 8 moves up, causes a large increase in the channel space 16 as illustrated in FIG. 2. This large channel space 16 allows for substantial amounts of ink to flow rapidly into the nozzle chamber 2 with the ink being drawn through the channel 16 by means of surface tension effects of the ink meniscus 3. The profiling of the nozzle chamber allows for the rapid refilling of the nozzle chamber with the arrangement eventually returning to the quiescent condition as illustrated in FIG. 1.

The arrangement 1 also comprises a number of other significant features. These comprise a circular rim 18, as shown in FIG. 1, which is formed around an external circumference of the paddle 8 and provides for structural support for the paddle 8 whilst substantially maximising the distance between the meniscus 3, as illustrated in FIG. 3, and the paddle surface 8. The maximising of this distance reduces the likelihood of the meniscus 3 making contact with the paddle surface 8 and thereby affecting the operating characteristics. Further, an ink outflow prevention lip 19 is provided for reducing the possibility of ink wicking along a surface 20 and thereby affecting the operating characteristics of the arrangement 1.

Figure 4:
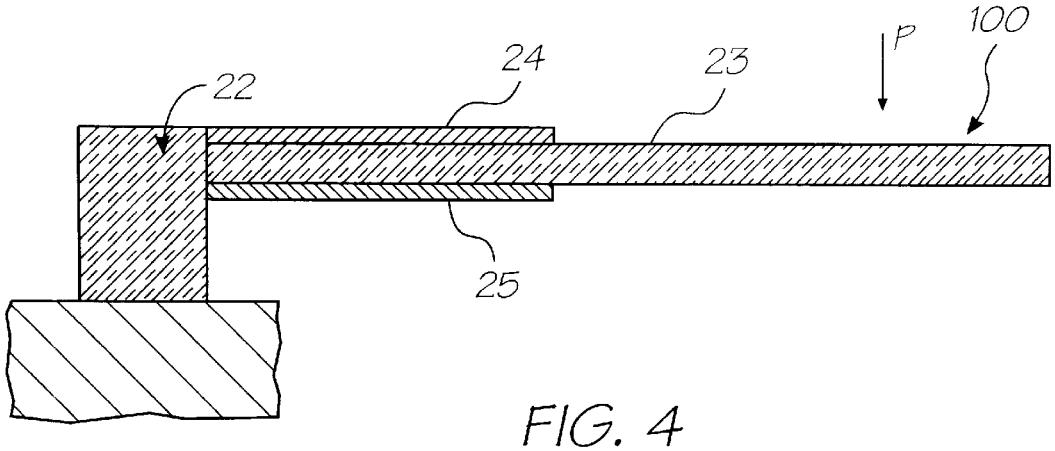
FIG. 4 to FIG. 6 illustrate schematically a first form of thermal actuator.
Figure 5:
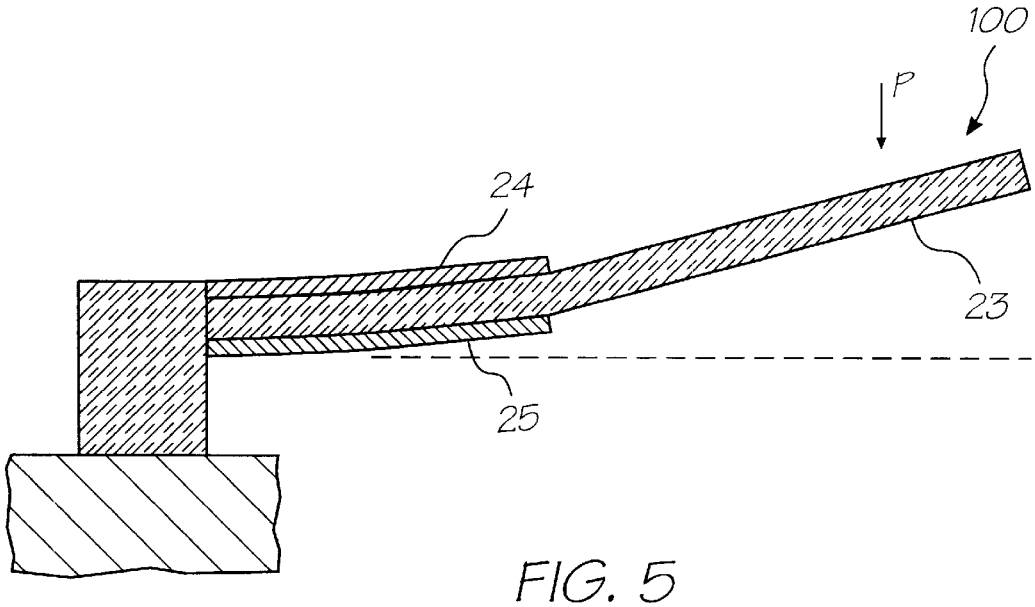

The principles of operation of the thermal actuator 7 will now be described initially with reference to FIG. 4 to 10. In FIG. 4 there is shown a thermal actuator 100 attached to a substrate 22 which comprises an actuator body 23 on both sides of which are activating arms 24 and 25. The two arms 24 and 25 are preferably formed from the same material.

To activate the actuator, the bottom arm 25 is heated by passing electrical current through the arm. Thermal expansion makes the bottom arm 25 longer than the top arm 24 and, as they are connected at both ends, the bottom arm 25 is subject to compressive stress and the top arm is subject to tensile stress. In the absence of a restraining load, these stresses would be relieved by the structure 100 bending upwardly, with the two arms 24 and 25 forming arcs about a common center.

With a dynamic load (the paddle and ink) on the end of the actuator as indicated by P in FIG. 4, the motion of the structure 100 may be much more complex than a simple bend, creating second order distortions and buckling. These can be minimised by the correct choice of dimensions and materials of the structure 100.

Figure 6:
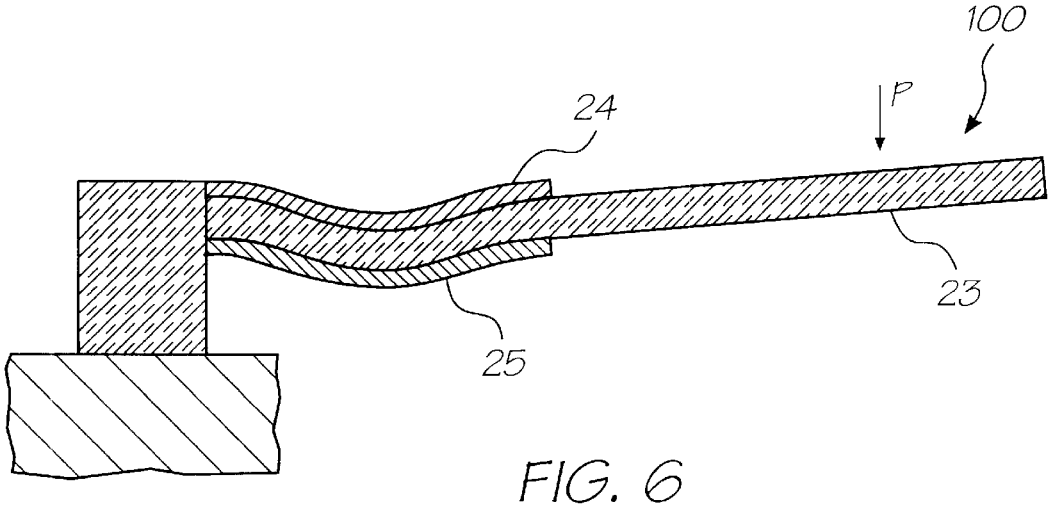
Figure 7:
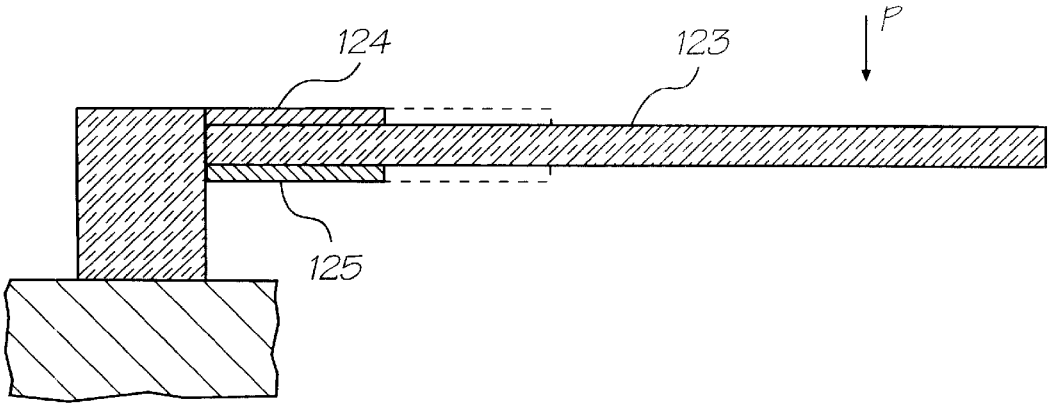
FIG. 7 and FIG. 8 illustrate schematically a second form of thermal actuator.

It has been found in practice that, if the arms 24 and 25 are too long, then the system may buckle as illustrated in FIG. 6 upon heating of the arm 25. This buckling reduces the operational effectiveness of the structure 100. The potential for buckling as illustrated in FIG. 6 can be substantially reduced by utilising smaller activating arms 124 and 125 with the modified arrangement as illustrated in FIG. 7. It is found that, when heating the lower arm 125 as illustrated in FIG. 8, the actuator body 123 bends in a upward direction and the potential for the system to buckle is substantially reduced.

Figure 8:
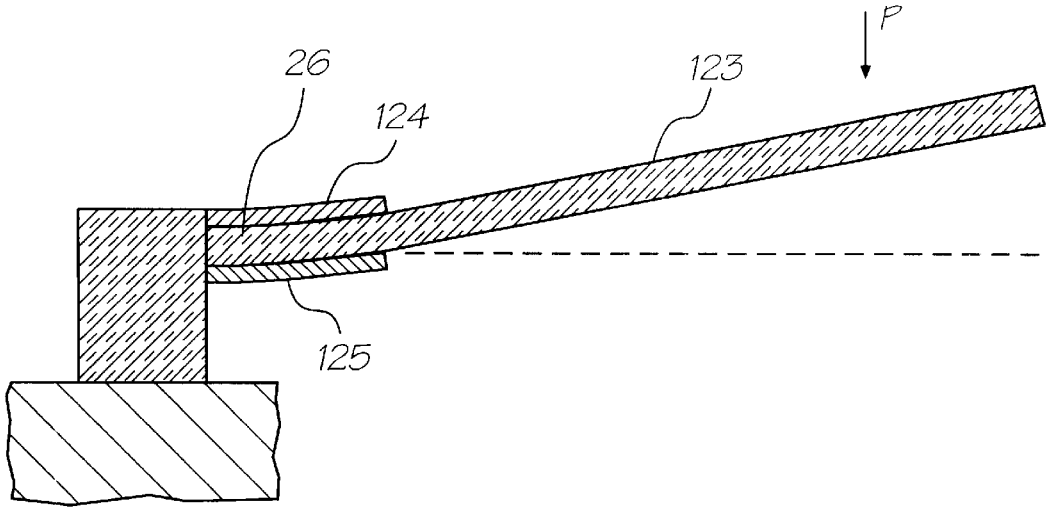

Further, it should be noted that in the arrangement of FIG. 8, the portion 26 of the actuator body 123 between the activating arm 124 and 125 will be subjected to shear stress and, as a result, operating efficiency may be reduced. Further, the presence of the material 26 can result in rapid heat conduction from the arm 125 to the arm 124.

The arm 125 should be subject to a temperature which can be tolerated by the body 123. Hence, the operating parameters are determined by the characteristics such as the melting temperature of the portion 26.

Figure 9:
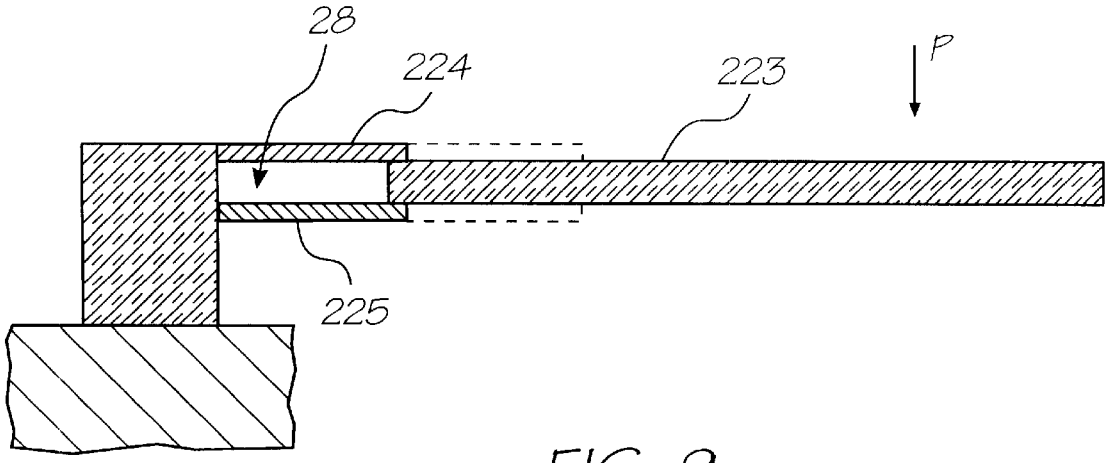
FIG. 9 and FIG. 10 illustrate schematically a third form of thermal actuator.
Figure 10:
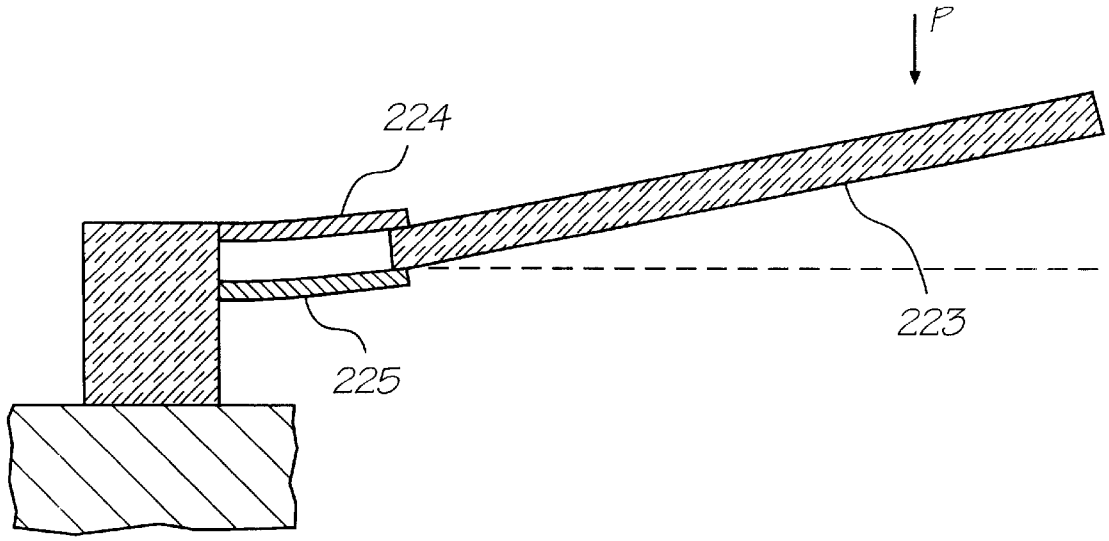

In FIG. 9, there is illustrated an alternative form of thermal actuator which comprises the two arms 224 and 225 and actuator body 223 but wherein there is provided a space or gap 28 between the arms. Upon heating one of the arms, as illustrated in FIG. 10, the arm 225 bends upwardly as before. The arrangement of FIG. 10 has the advantage that the operating parameters such as temperature of the arms 224, and 225 need not necessarily be limited by the material that is employed in the body 223. Further, the arrangement of FIG. 10 avoids induction of a shear force in the body 223 and minimises the risk of delamination during operation. These principles can be utilized in the thermal actuator of the arrangement of FIG. 1 to FIG. 3 so as to provide for a more energy efficient form of operation.

Figure 11:
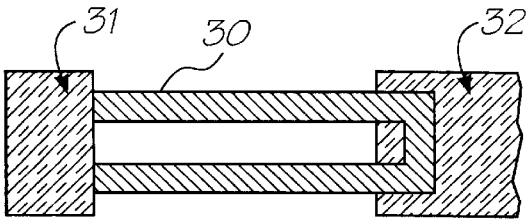
FIG. 11 illustrates schematically a further thermal actuator.
Figure 12:
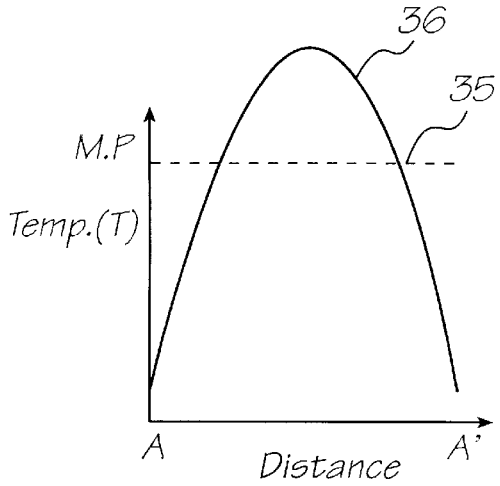
FIG. 12 shows a graph of temperature with respect to distance for the arrangement of FIG. 11.

Further, in order to provide a more efficient form of operation of the thermal actuator, a number of further refinements may be incorporated. The thermal actuator relies on induced heating and the arrangement utilized in the preferred embodiment can be schematically simplified as illustrated in FIG. 11 to a material 30 which is interconnected at a first end 31 to a substrate and at a second end 32 to a load. The arm 30 is heated so as to expand and exert a force on the load 32. Upon heating, the temperature profile will be approximately as illustrated in FIG. 12. The two ends 31 and 32 act as "heat sinks" for the heat and so the temperature profile is cooler at each end and hottest in the middle. The operational characteristics of the arm 30 will be determined by the melting point 35 in that, if the temperature in the middle 36 exceeds the melting point 35, the arm may fail. The graph of FIG. 12 represents a non-optimal result in that the arm 30 in FIG. 11 is not heated uniformly along its length.

Figure 13:
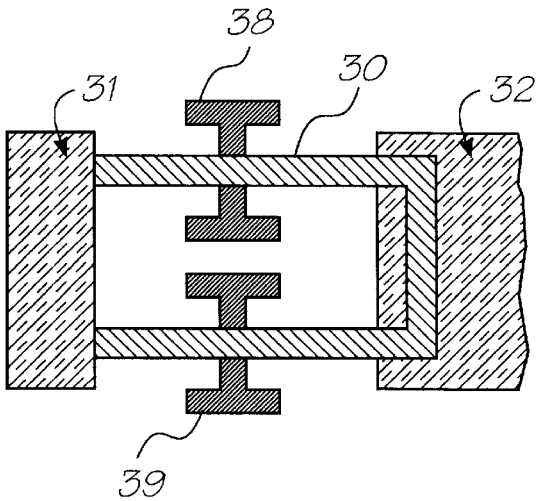
FIG. 13 illustrates schematically a further form of thermal actuator.
Figure 14:
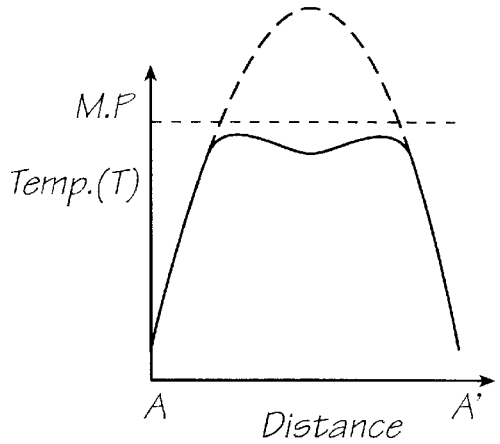
FIG. 14 illustrates shows a graph of temperature with respect to distance for the arrangement of FIG. 13.

By modifying the arm 30, as illustrated in FIG. 13, through the inclusion of heat sinks 38 and 39 in a central portion of the arm 30, a more desirable thermal profile, as illustrated in FIG. 14, can be achieved. The profile of FIG. 14 shows a more uniform heating across the length of the arm 30, thereby providing for more efficient overall operation.

Figure 15:
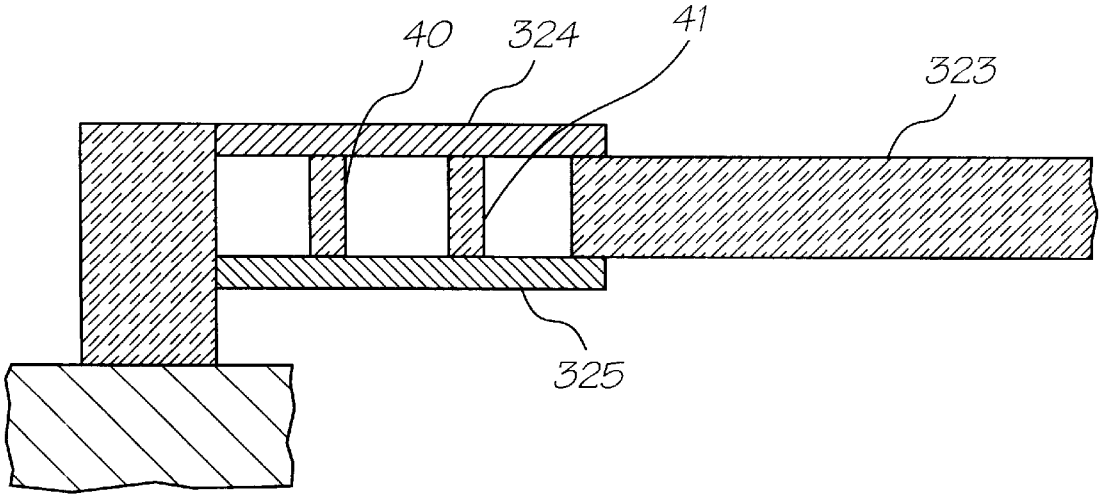
FIG. 15 illustrates schematically a further form of thermal actuator.

As shown in FIG. 15, further efficiencies and a reduction in the potential for buckling may be achieved by providing a series of struts to couple the two actuator activation arms 324 and 325. A series of struts 40 and 41 are provided to couple the two arms 324 and 325 to prevent buckling thereof. Hence, when the bottom arm 325 is heated, it is more likely to bend upwardly, causing the actuator body 323 also to bend upwardly.

In a further modification, the thermal actuator is formed with a series of protuberances 55 and 56 which are strategically placed so as to provide a fine thermal tuning of the operation of the thermal actuator.

Figure 16:
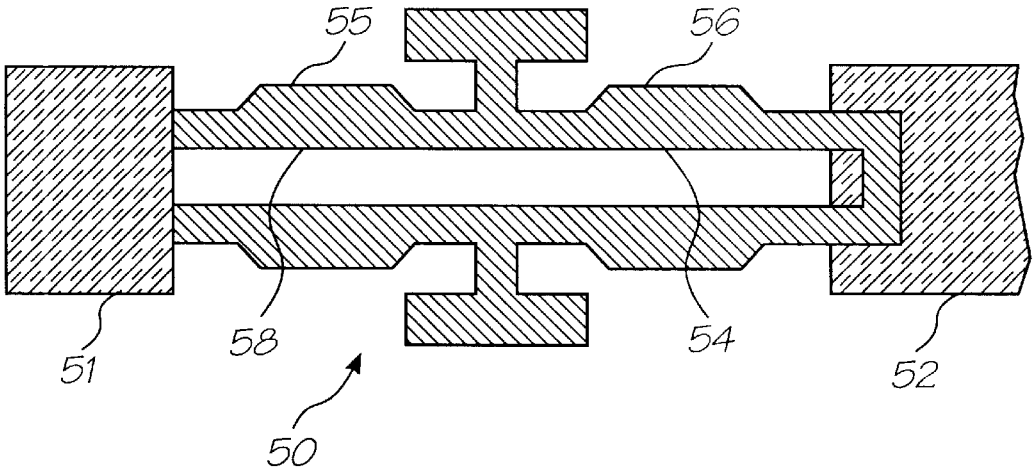
FIG. 16 illustrates schematically a top view of a thermal actuator.

As shown in FIG. 16 there is illustrated schematically a top plan view of the thermal actuator 50 which is attached to a first substrate 51 and which is designed to act on a load 52. The conductive actuating portion 54 comprises two protuberances 55 and 56 which act to reduce temperature in those regions by having a larger cross sectional thickness than, say, the cross sectional region 58.

Figure 17:
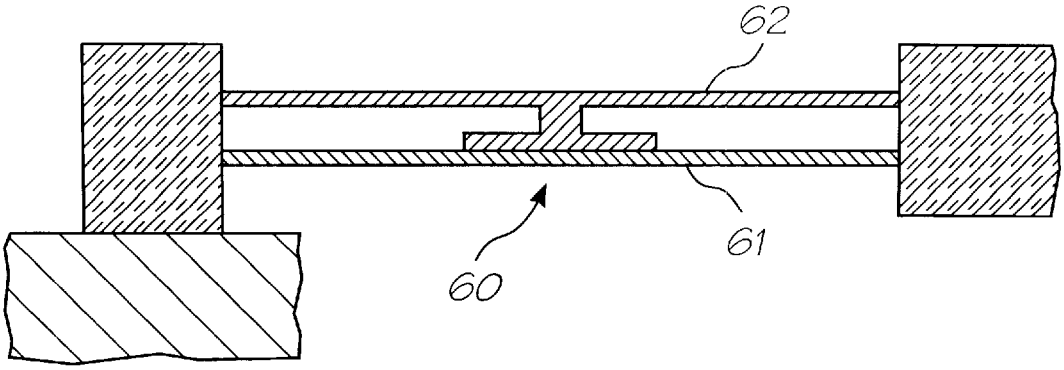
FIG. 17 illustrates a side view of the thermal actuator.

FIG. 17 illustrates a side view of a coupling 60 between a lower layer 61 and an upper layer 62.

Figure 18:
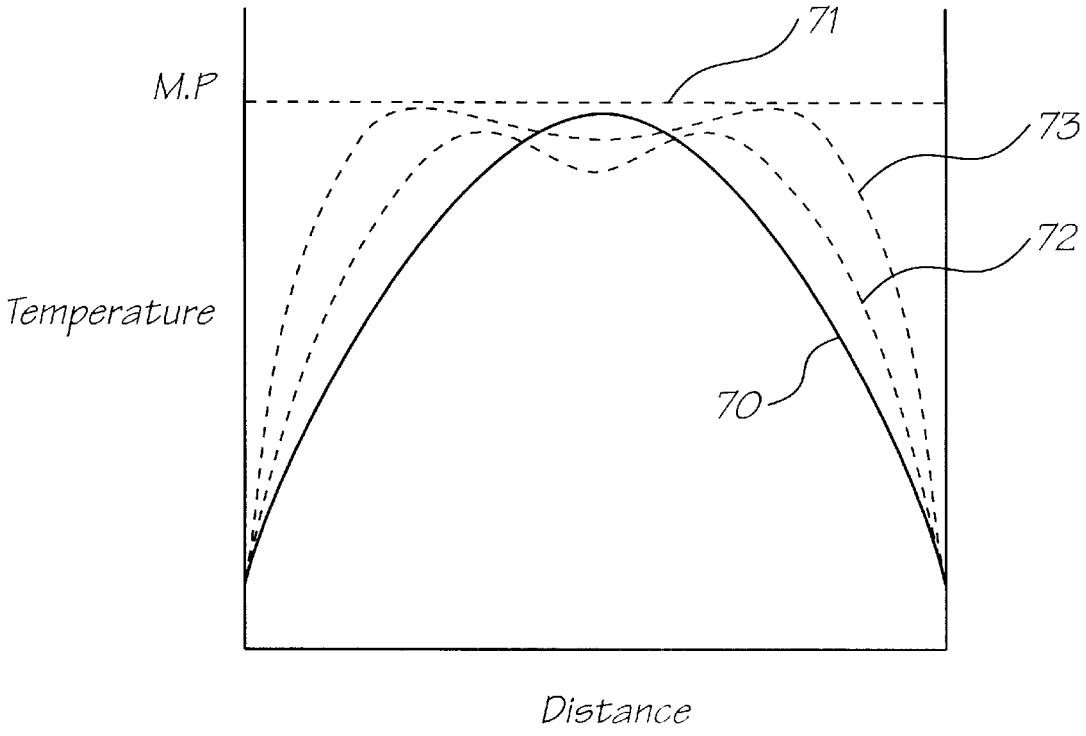
FIG. 18 illustrates shows graphs of temperature with respect to distance for three different actuator arrangements.

In FIG. 18 there is illustrated a graph of the resultant heating schemes for the different arrangements. The curve 70 is the resultant thermal profile for an arrangement such as that illustrated in FIG. 11. The second curve 72 is for the arrangement of FIG. 13 when having a central heat sink. The third curve 73 is the resultant thermal profile for the arrangement of FIG. 16.

It has been found in simulations that the amount of bending is proportional to the energy expended in heating. This energy in turn is related to the area under the curves 70 to 73 and, as the efficiency of bending is proportional to the temperature and the arrangement of FIG. 16 allows for relatively high temperature along the actuator 54, it is likely that the arrangement of FIG. 16 should be more efficient than other illustrated arrangements.

Figure 19:
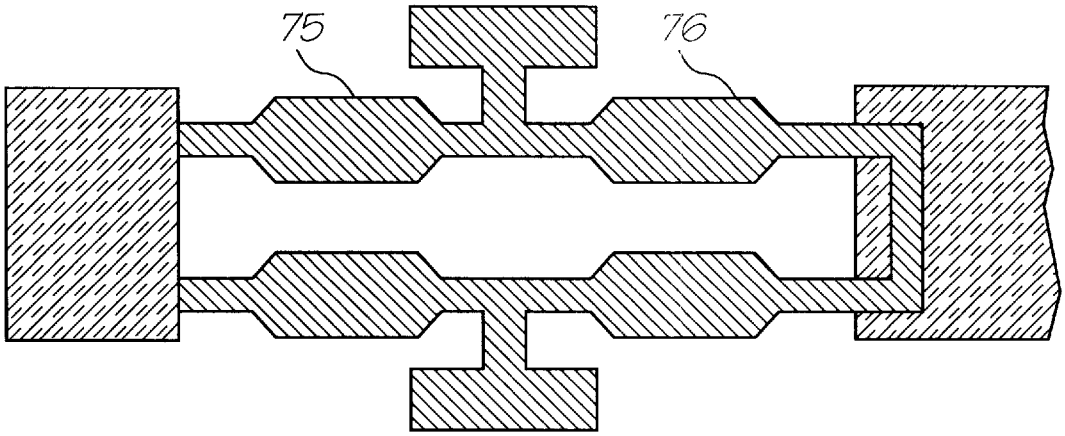
FIG. 19 illustrates an alternative actuator arrangement.

Still further arrangements are possible. For example, in FIG. 19 there is illustrated slightly modified form of the actuator which incorporates two protuberances 75 and 76.

Figure 20:
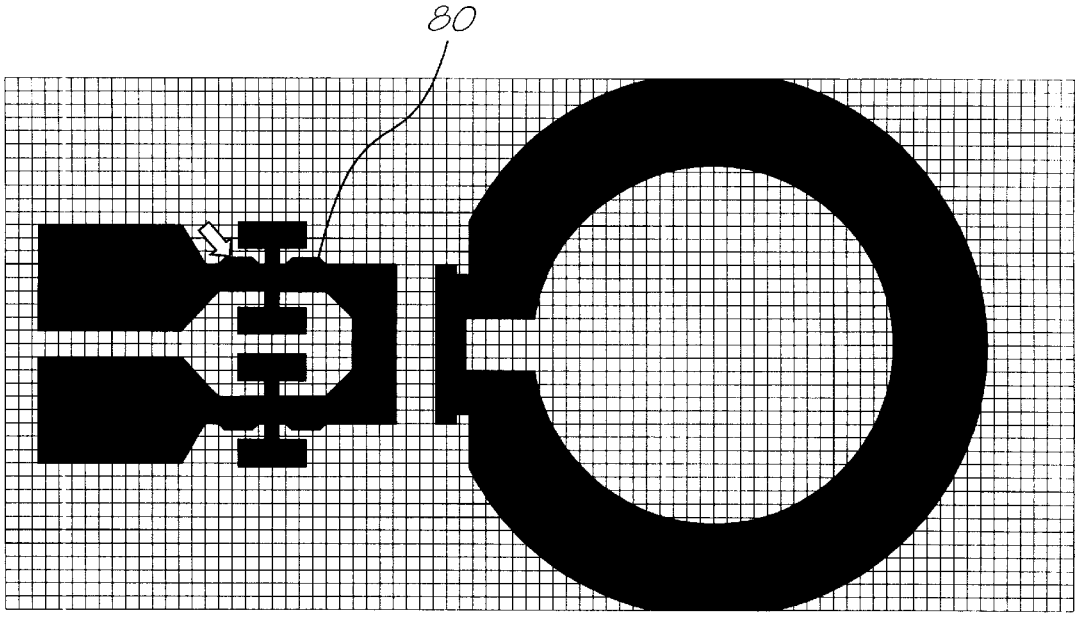
FIG. 20 illustrates a semi-conductor mask for use in the fabrication of a thermal ink jet print head nozzle that incorporates the features of the invention.
Figure 21:
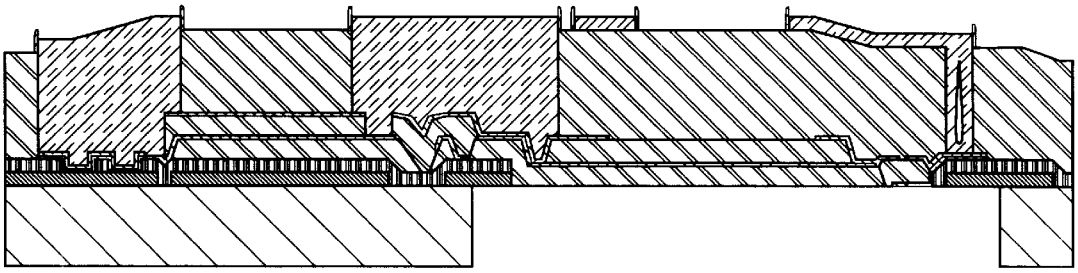
FIG. 21 illustrates a thermal actuator device that is fabricated by employment of the mask of FIG. 20.

The principle as described above with reference to FIG. 18 may be utilised in adapting the operation of a micro electro-mechanical system that contains a thermal actuator. A mask for use in fabricating a micro electro-mechanical system is illustrated in FIG. 20. This includes a series of protuberances 80 which provide alternative heat distributing arrangements. A sectional view of the ink jet print head is illustrated in FIG. 21.

It would be appreciated by a person skilled in the art that numerous variations and/or modifications may be made to the present invention as shown in the preferred embodiment without departing from the spirit or scope of the invention as broadly described. The preferred embodiment is, therefore, to be considered in all respects to be illustrative and not restrictive.

I claim:

1. A thermal actuator for a micro electro-mechanical device, the actuator comprising a first conductive material arm having a first end thereof attached to a substrate and a second end thereof connected to or integrated with a movable element, the first arm being arranged, in use, to be heated by passage of electrical current and the first arm including means for providing a lengthwise temperature profile along the arm in which heat is concentrated in the arm to a region adjacent said first end.

2. The thermal actuator as claimed in claim 1 and including a second arm which extends between the substrate and the movable element and which is arranged such that, when the first arm is heated, the first arm is caused to expand relative to the second arm and exert a deflecting force on the movable element.

3. The thermal actuator as claimed in claim 2 wherein the second arm is coupled to the first arm by a coupling means.

4. The thermal actuator as claimed in claim 3 wherein the coupling means is located intermediate the ends of the first arm.

5. The thermal actuator as claimed in claim 4 wherein the coupling means is located approximately mid-way between the ends of the first arm.

6. The thermal actuator as claimed in claim 2 wherein the first arm is formed intermediate its ends with at least one thermal sink.

7. A liquid ejector comprising a nozzle chamber, a liquid ejection aperture in one wall of the chamber, a liquid ejection paddle located within the chamber and a thermal actuator extending into the chamber by way of an access aperture in a second wall of the chamber, the thermal actuator comprising a first conductive material arm which is attached at a first end thereof to a substrate and which is connected at a second end thereof to the liquid ejection paddle, the first arm being arranged, in use, to be heated by passage of electrical current and the first arm including means for providing a lengthwise temperature profile along the arm in which heat is concentrated in the arm to a region adjacent said first end whereby, in use of the ejector, when the first arm is heated the liquid ejection paddle is caused to move from a first position to a second position to thereby cause ejection of liquid through the liquid ejection aperture.

8. The liquid ejector as claimed in claim 7 wherein the thermal actuator includes a second arm which extends between the substrate and the liquid ejection paddle and which is arranged such that, when the first arm is heated, the first arm is caused to expand relative to the second arm and to exert a deflecting force on the liquid ejection paddle.

9. A thermal actuator for a micro electro-mechanical device, the actuator comprising a first conductive material arm having a first end thereof attached to a substrate and a second end thereof connected to or integrated with a movable element, the first arm being arranged, in use, to be heated by passage of electrical current and the first arm including means for providing a lengthwise temperature profile along the arm in which heat is concentrated in the arm to a region adjacent said first end, the thermal actuator further including a second arm which extends between the substrate and the movable element and which is arranged such that, when the first arm is heated, the first arm is caused to expand relative to the second arm and exert a deflective force on the movable element, the second arm being coupled to the first arm by a coupling means located intermediate the ends of the first arm.

10. A thermal actuator for a micro electro-mechanical device, the actuator comprising a first conductive material arm having a first end thereof attached to a substrate and a second end thereof connected to or integrated with a movable element, the first arm being arranged, in use, to be heated by passage of electrical current and the first arm including means for providing a lengthwise temperature profile along the arm in which heat is concentrated in the arm to a region adjacent said first end, the thermal actuator including a second arm which extends between the substrate and the movable element and which is arranged such that, when the first arm is heated, the first arm is caused to expand relative to the second arm and exert a deflective force on the movable element, and wherein the first arm is formed intermediate its ends with at least one thermal sink.

* * * * *